US007955774B2

(12) United States Patent
Maehata et al.

(10) Patent No.: US 7,955,774 B2
(45) Date of Patent: Jun. 7, 2011

(54) ELECTROSTATIC DEVELOPING TONER, METHOD OF PRODUCING THE SAME, ELECTROSTATIC DEVELOPER AND IMAGE FORMING METHOD

(75) Inventors: Hideo Maehata, Minamiashigara (JP); Susumu Yoshino, Minamiashigara (JP); Noriyuki Mizutani, Minamiashigara (JP); Satoshi Yoshida, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1208 days.

(21) Appl. No.: 11/296,372

(22) Filed: Dec. 8, 2005

(65) Prior Publication Data

US 2006/0292476 A1 Dec. 28, 2006

(30) Foreign Application Priority Data

Jun. 27, 2005 (JP) ..... 2005-186757

(51) Int. Cl.
*G03G 9/087* (2006.01)

(52) U.S. Cl. ..... 430/109.4; 430/124.1; 430/137.14

(58) Field of Classification Search ..... 430/109.4, 430/124.1, 137.14
See application file for complete search history.

(56) References Cited

U.S. PATENT DOCUMENTS

| | | | | |
|---|---|---|---|---|
| 5,948,584 | A * | 9/1999 | Hashimoto et al. | 430/109.3 |
| 2002/0013427 | A1 * | 1/2002 | Tsuji et al. | 525/523 |
| 2002/0042013 | A1 * | 4/2002 | Aoki et al. | 430/111.4 |
| 2004/0191656 | A1 * | 9/2004 | Ishiyama et al. | 430/106.1 |
| 2005/0031871 | A1 * | 2/2005 | Kinsho et al. | 428/402 |
| 2005/0245694 | A1 * | 11/2005 | Matsumura et al. | 525/437 |
| 2006/0216627 | A1 * | 9/2006 | Mizutani et al. | 430/109.4 |
| 2007/0082285 | A1 * | 4/2007 | Matsuoka et al. | 430/109.3 |

FOREIGN PATENT DOCUMENTS

| | | | |
|---|---|---|---|
| JP | A 2000-284538 | | 10/2000 |
| JP | A 2000-302854 | | 10/2000 |
| JP | 2004151709 | * | 5/2004 |
| WO | WO 2005038531 | * | 4/2005 |

* cited by examiner

*Primary Examiner* — Christopher RoDee
*Assistant Examiner* — Rachel L Zhang
(74) *Attorney, Agent, or Firm* — Oliff & Berridge, PLC

(57) ABSTRACT

An electrostatic image developing toner comprising a non-crystalline polyester resin, wherein the non-crystalline polyester resin is obtained by copolymerizing monomers in the presence of a titanium catalyst; the monomers comprise a polyhydric alcohol component and a monomer containing a sulfonic acid group, the polyhydric alcohol component comprises a propylene oxide adduct of bisphenol A, a ratio of an amount of the monomer containing a sulfonic acid group to the total amount of the non-crystalline polyester resin is 0.1 mol % to 20 mol %, and a content of titanium is 1 ppm to 1000 ppm by weight based on the amount of the resin. The invention also provides a method for producing the same, an electrostatic image developer and image forming method using the toner.

11 Claims, No Drawings

ELECTROSTATIC DEVELOPING TONER, METHOD OF PRODUCING THE SAME, ELECTROSTATIC DEVELOPER AND IMAGE FORMING METHOD

CROSS-REFERENCE TO RELATED APPLICATION

This application claims priority under 35 USC 119 from Japanese patent Application No. 2005-186757, the disclosure of which is incorporated by reference herein.

BACKGROUND OF THE INVENTION

1. Field of the Invention

The present invention relates to a toner for developing electrostatic images to be used in electrophotographic apparatuses that utilize the electrophotographic process, such as copying machines, printers, facsimiles, and the like, and a manufacturing method thereof, a developer for electrostatic images using the toner for developing electrostatic images, and an image forming method utilizing the toner for developing electrostatic images.

2. Description of the Related Art

Methods for visualizing image information through an electrostatic latent image, such as the electrophotographic method, or the like, are widely used in various fields at present. With the electrophotographic method, an electrostatic latent image on the surface of a photosensitive material is developed through a charging step, an exposure process, and the like, and the electrostatic latent image is visualized through a transfer step, a fixing step, and the like.

A number of methods are known as electrophotographic methods. In general, a latent image is formed electrically by one of various means on the surface of a photorecepter (latent image holding member) which utilizes a photoconductive substance. The formed latent image is developed with a toner to form a toner image. Thereafter, the toner image on the surface of the photorecepter is transferred onto the surface of an image receiving material such as paper or the like optionally via an intermediate transfer material. The transferred image is subjected to a fixing process such as heating, pressurizing, heat-pressurizing, or the like, such that a fixed image is formed. Toner which remains on the surface of the photorecepter is cleaned by various methods as necessary and may be utilized for development of a toner image again, as required.

As a fixing technique for fixing a transferred image which has been transferred onto the surface of an image receiving material, a heat roll fixing method is used generally. In this method, an image receiving material having a toner image transferred thereto is inserted and fixed between a pair of rolls (a heat roll and a pressure roll).

Generally, a polyester resin or a vinyl polymer using polystyrene as its base is commonly used as an electrophotographic toner material from the viewpoint of its antistatic characteristics, resin strength and coloring property upon being mixed with a colorant. Particularly, the polyester resin among these toner materials is produced from a polyvalent carboxylic acid and a polyhydric alcohol by a dehydration or ester exchange in the presence of a polycondensation catalyst. In the production process, an organic tin catalyst has been usually used as the polycondensation catalyst from the viewpoint of, for example, its polymerizing speed and generation of byproducts. However, in recent years, a lot of discussion has arisen as to the effects of residual organic tin on the environment and the human body. Therefore, energetic studies are conducted concerning the shift from the organic tin catalyst to a catalyst containing an element other than tin such as titanium, antimony or aluminum (see, for example, Japanese Patent Application Laid-Open (JP-A) Nos. 2000-302854 and 2000-284538).

However, electrophotographic toners produced using these catalysts other than tin have various problems which should be solved to enable practical use; for example, charging faults due to a residual catalyst or side-reactions, reduced color-developing characteristics due to coloring of a resin and limitation on industrially polymerizable polyester monomers (polymerization reactivity) and particularly, a difficulty in the use of propylene oxide adducts of bisphenol A which are necessary to attain a good balance between sufficient strength and antistatic characteristics required for electrophotographic toners.

On the other hand, with increased demand for saving the power required for image formation in recent years, the technological development of a so-called low-temperature fixing toner which aims at saving the electric power consumed in the fixing process, which is one of the processes consuming the highest amount of energy in the electrophotographic process, has been actively promoted.

In the low-temperature fixing toner, a lowered fixing temperature of the toner generally involves simultaneous decrease in the glass transition point of the toner, which makes it difficult to achieve all of the lowered fixing temperature, the desired toner shelflife, and the desired preservability (offset resistance) of the final output image obtained. Therefore, in order to achieve both of the low-temperature fixability and the desired toner shelflife, the toner is required to have so-called sharp melting characteristics, which are such characteristics that the viscosity of the toner is decreased sharply in the vicinity of the fixing temperature while the glass transition point of the toner is maintained high.

As a promising approach to the above technical problems, a method has been proposed in which a crystalline resin having sharp melting property is used as a binder resin.

In an electrophotographic full-color toner, a polyester resin has been conventionally used as the binder resin because of its superior coloring property and adhesiveness to paper. Therefore, energetic studies are conducted with respect to crystalline polyesters as the crystalline resin having sharp melting property.

Also, along with a demand for high image quality in current electrophotographic technologies, there have been many studies on reduction of the size of particles in a method of producing toner chemically (e.g., dissolution suspension, emulsion-polymerization aggregation, or suspension polymerization). Studies have been also conducted on the combination of these crystalline resins and low-temperature fixing techniques. However, these crystalline resins, especially, crystalline polyesters have the following problems concerning the electric characteristics and image characteristics of the resins when applied to electrophotographic toner. These problems are obstacles to the practical use of these resins.

When a crystalline resin is applied to an electrophotographic toner so as to achieve low-temperature fixability, the melting point of the resin is an important factor in the selection of the resin. In general, when the electrophotographic toner aims at low-temperature fixing, it is important to select a material which melts sharply at a temperature as low as possible, namely a material having a low melting point. It is also important for the toner to have storage stability required for the toner and post-fixing image blocking characteristics. Therefore, crystalline resins having a melting point of about 80° C. are widely studied at present. However, these crystalline resins having low melting points have electric resistances as low as about 1/100 to 1/1000 the electric resistance of a resin usable for usual electrophotographic toner. When these crystalline resins are blended as a toner component in a toner, the charge of the toner is small and also, the electrified charge gradually leaks with time; therefore, big practical problems of charging inferiors due to low electrification and the leakage of charge accompany the resultant electrophotographic toner utilizing electrification by friction as its basic principle.

Also, the aforementioned crystalline resin having a melting point of about 80° C. has a skeleton mainly composed of a long alkyl chain as its resin skeleton and is therefore fragile and has poor toughness. Therefore, the use of the crystalline toner as electrophotographic toner easily poses the problem concerning collapse of the toner in a machine due to a lack of resin strength and cleaning inferior caused by filming on the photoreceptor, thereby causing defects in final images.

To deal with these problems, studies as to a polymer blend method have been energetically made in recent years in which a crystalline resin mixed with a non-crystalline resin that is currently used as an electrophotographic toner material is used as electrophotographic toner. In this method, important technical requirements for the polymer blend are that the resins to be mixed have moderate compatibility with each other and preferably have a UCST (Upper Critical Solution Temperature) representing the so-called semi-compatibility. Since the crystalline resin to be used has a structure based on an alkyl chain as described above, the structure has very low polarity and therefore the so-called resin structure has a low SP value.

Accordingly, the non-crystalline resin to be used has to be designed to have a low SP value from the viewpoint of its compatibility. As the non-crystalline resin having a low SP value to be used as an electrophotographic toner material, a resin having a skeleton including a propylene oxide adduct of bisphenol A will become more important. However, when the propylene oxide adduct of bisphenol A is used in the future, the problem as to its production and technical problems accompanying its application to an electrophotographic toner described above should be solved.

As explained above, in the technical prospects of the electrophotographic toner, there is a large problem concerning how to produce a polyester resin by polymerizing a monomer component of a propylene oxide adduct of bisphenol A in the presence of a tin-free catalyst without impairing image characteristics such as charging characteristics and coloring property so as to put the polyester resin in practical use.

SUMMARY OF THE INVENTION

The invention has been made in view of the aforementioned prior art problems.

In view of this situation, the inventors of the invention have made intensive studies and as a result, found that the above problems can be solved by using the following electrostatic image developing toner, method of producing the electrostatic image developing toner, electrostatic developer and image forming method using the electrostatic image developing toner, thereby reaching the invention.

The invention provides an electrostatic image developing toner comprising at least a non-crystalline polyester resin, wherein the non-crystalline polyester resin is a resin obtained by copolymerizing a group of monomers in the presence of a titanium catalyst. The monomers include at least a polyhydric alcohol component and a monomer containing a sulfonic acid group. The polyhydric alcohol component includes a propylene oxide adduct of bisphenol A. The ratio of the amount of the monomer containing a sulfonic acid group is 0.1 mol % to 20 mol % based on the total amount of the non-crystalline polyester resin, and the content of titanium is 1 ppm to 1000 ppm by weight based on the amount of the resin.

The non-crystalline polyester resin may have a Gardner color scale of 3 or less. The non-crystalline polyester resin may have a second transition temperature (Tg) of 50° C. to 70° C., and a softening point ((½) drop temperature in a measurement with a flow tester, Tm) of 90° C. to 120° C. The non-crystalline polyester resin may comprise dodecenylsuccinic acid, which is a polyvalent carboxylic acid, as a copolymerization component in an amount of 1 mol % to 20 mol % based on the total amount of acid component in the non-crystalline polyester resin. The toner may further comprise a crystalline resin in an amount of 3% by weight to 50% by weight. The crystalline resin may be a crystalline polyester resin. The non-crystalline resin may comprise a linear aliphatic diol whose main chain has 2 to 20 carbon atoms. The toner may further comprise a releasing agent having a melting point of 50 to 100° C.

The invention also provides a method of producing the electrostatic image developing toner. The method comprises: mixing a resin fine particle dispersion liquid containing one or more non-crystalline resins with a colorant dispersion liquid containing a colorant dispersed therein; allowing the resin fine particles and the colorant to aggregate in an aqueous medium to form aggregates having a toner particle diameter; and then heating the aggregate to fuse the components in each aggregate. At least one of the non-crystalline resins is a resin obtained by copolymerizing a group of monomers including at least a polyhydric alcohol component and a monomer containing a sulfonic acid group in the presence of a titanium catalyst. The polyhydric alcohol component includes a propylene oxide adduct of bisphenol A. The ratio of the amount of the monomer containing a sulfonic acid group to the total amount of non-crystalline polyester resin is 0.1 mol % to 20 mol %.

The method may comprise adhering at least one non-crystalline polyester resin to the surfaces of the aggregates after the formation of aggregates, and heating the aggregates to fuse the components of each aggregate.

The invention further provides an electrostatic image developer comprising any of the above electrostatic image developing toners and a carrier. The carrier may be coated with a resin, and the resin may comprise a conductive material. The volume average particle diameter of the carrier may be 10 to 500 μm.

The invention further provides an image forming method comprising: forming an electrostatic latent image on the surface of a latent image holding member; developing the electrostatic latent image formed on the latent image holding member with a developer containing a toner to form a toner image; transferring the toner image formed on the surface of the latent image holding member to the surface of an image receiving member; and thermally fixing the toner image transferred to the surface of the image receiving member, wherein the toner is any of the above the electrostatic image developing toners.

The invention can provide an electrostatic image developing toner which uses a polyester resin including, as a monomer component, a propylene oxide adduct of bisphenol A produced without using a tin-based catalyst. The toner has satisfactory image characteristics such as electrification properties and coloring property and is capable of low-temperature fixing. The invention further provides a method of producing the toner, and an electrostatic image developer and an image forming method using the electrostatic image developing toner.

DETAILED DESCRIPTION OF THE INVENTION

The electrostatic image developing toner of the invention comprises at least a non-crystalline polyester resin. The non-crystalline polyester resin is obtained by copolymerizing a group of monomers including at least a polyhydric alcohol component and a monomer containing a sulfonic acid group in the presence of a titanium catalyst. The polyhydric alcohol component includes a propylene oxide adduct of bisphenol A. The ratio of the monomer containing a sulfonic acid group to the total amount of the non-crystalline polyester resin is 0.1 mol % to 20 mol %, and the content of titanium is 1 ppm to 1000 ppm by weight based on of the resin.

The content of titanium is determined based on the measurement with fluorescent X-rays and a separately-obtained calibration curve.

In the invention, the term "crystalline resin" refers to a resin having a clear endothermic peak in a temperature range of 0 to 150° C. in thermal analysis using a differential scanning calorimeter (DSC). In contrast, the term "non-crystalline resin" refers to a resin not having a clear melting endothermic peak in thermal analysis using a differential scanning calorimeter (DSC).

Important technical features of the invention are as follows: there have been difficulty in putting a propylene oxide adduct of bisphenol A to practical use because of the problems concerning image characteristics such as electrification properties and resin coloring property. However, in the invention, a polyester resin is obtained by polymerizing a propylene oxide adduct of bisphenol A as a monomer component without using a tin catalyst (that is, by using a tin-free catalyst), and is used as a binder resin for an electrophotographic toner. Specifically, a certain amount of a monomer containing a sulfonic acid group is introduced into the resin structure by copolymerization in the presence of a titanium catalyst, so that a certain amount of titanium is contained in the toner. It has been found that in this technique, the presence of a sulfonic acid group in the resin structure can greatly improve the coloring property of the resin despite the fact that the use of a titanium catalyst usually results in problematic coloring property. Further, it has been also found that the presence of titanium in the final toner can remarkably improve the electrification properties, especially initial electrification properties and its environmental dependency although the conventional use of tin-free catalyst have produced problems related to such properties of the resultant polyester resin. In this way, the invention was made.

It is conventionally considered that when a polyester is produced by polycondensation, the catalyst used is not left in the separate state after polymerization, but most catalyst is linked to the structure or terminal of the resin electronically or ionically through a certain transition state.

Also, with regard to the friction electrification properties of a polymer material, various studies have been made as to, for example, the relationship between the chemical structure and electrification properties. As a result, it has been found that the electrification properties of a polymer are dependent on its chemical structure. It is, at present, systematically classified to some extent what structure should be introduced for the control of the electrification properties (e.g., positive electrification or negative electrification), and the order of electrification has been obtained. However, clear relationship between the difference in the electrification properties (quantity of charge) of a polymer and its chemical structure (chemical composition, molecular configuration and spatial configuration) has not been obtained, and the electrification properties have not been fully understood. Therefore, detailed research is still ongoing at present in fact. For controlling the electrification of electrophotographic toner, charge regulators having various polar groups are incorporated into the toner. However, the details of the relationship between the type of the polar groups and the electrification properties have not been sufficiently clarified.

Accordingly, there are many unclear points in the mechanism of the improvements of the coloring property and electrification properties of the resin in the invention. The improvement in the control of electrification is supposedly derived from the ionic or electronic interaction between a strongly acidic sulfonic acid group incorporated into the resin and a titanium element, and the improvement in resin coloring property is supposedly derived from the interaction with the sulfonic acid group.

The propylene oxide adduct of bisphenol A to be used in the invention is a dihydric alcohol represented by the following formula (1), in which propylene oxide is added to the hydroxyl groups on both terminals of 2,2-bis(4-hydroxyphenyl)propane. In the formula, n and m each represent an integer of 1 to 5, preferably an integer of 2 or less.

Formula (1)

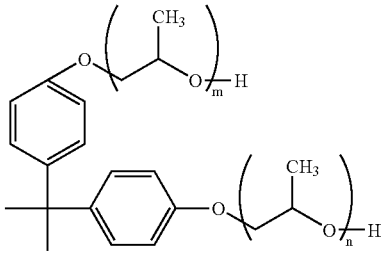

In the invention, the proportion of the propylene oxide adduct of bisphenol A as a copolymerization component to all the polyhydric alcohol components of the non-crystalline polyester resin is preferably 50 mol % or higher, and more preferably 60 mol % or higher. When the copolymerization ratio of the propylene oxide adduct of bisphenol A to all the polyhydric alcohol components is lower than 50 mol %, there is a case where it is difficult to attain sufficient resin strength and electrification properties as an electrophotographic toner.

Also, in the invention, it is preferable to copolymerize an ethylene oxide adduct of bisphenol A and/or a butylene oxide adduct of bisphenol A (those obtained by replacing the propylene oxide in the formula (1) with ethylene oxide or butylene oxide) together with the propylene oxide of bisphenol A as all the polyhydric alcohol components of the non-crystalline polyester resin, so as to produce a non-crystalline polyester resin with less fragility.

The monomer containing a sulfonic acid group in the invention comprises a sulfonic acid group or a sulfonic acid salt group in the structure of a polyvalent carboxylic acid or polyhydric alcohol that can be used as a copolymer component of the polyester. The monomer may be, for example, sulfoterephthalic acid, 5-sulfoisophthalic acid, 4-sulfoisophthalic acid or 4-sulfonaphthalene-2,7 dicarboxylic acid, or an ammonium, Li, Na, K, Mg, Ca, Cu, or Fe salt of any of the above acids. Among these compounds, 5-sulfoisophthalic acid is preferable and Na salt of 5-sulfoisophthalic acid is particularly preferable. The proportion of the monomer containing a sulfonic acid group to the total amount of the non-crystalline polyester resin may be 0.1 mol % to 20 mol %, preferably 0.2 mol % to 3.0 mol %, and more preferably 0.5 mol % to 2.0 mol %. When the proportion of the monomer containing a sulfonic acid group is lower than 0.1 mol %, the electrification properties and image characteristics are insufficient for use as an electrophotographic toner of the invention. When the proportion exceeds 20 mol %, on the other hand, the moisture absorbing characteristics of a resin is deteriorated, so that satisfactory electrification stability cannot be obtained; therefore, such a resin is not suitable for use as a toner material for electrophotography.

In the invention, the aforementioned non-crystalline polyester resin is prepared by copolymerizing monomers including at least a polyhydric alcohol (including a propylene oxide adduct of bisphenol A) and a monomer containing a sulfonic acid group in the presence of at least one titanium catalyst.

Also, the finally-obtained electrostatic image developing toner of the invention contains titanium in an amount by weight of 1 ppm to 1000 ppm, preferably 5 ppm to 800 ppm, and more preferably 10 ppm to 500 ppm. When the content of titanium is less than 1 ppm, the electrification properties of the toner are insufficient, whereas when the content of titanium exceeds 1000 ppm, image characteristics are deteriorated, for example owing to the coloration of the resin.

Examples of the titanium catalyst include titanium tetraethoxide, titanium tetrapropoxide, titanium tetraisopropoxide and titanium tetrabutoxide. However, other additional catalysts may be used together insofar as the titanium content in the final toner is within the above-described range. Examples of the additional catalysts include compounds of alkali metals such as sodium and lithium, compounds of alkali earth metals such as magnesium and calcium, compounds of metals such as zinc, manganese, antimony, titanium, tin, zirconium and germanium, phosphorous acid compounds, phosphoric acid compounds and amine compounds.

Specific examples of the additional catalysts include sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, antimony trioxide, triphenylantimony, tributylantimony, zirconium tetrabutoxide, zirconium naphthenate, zirconyl carbonate, zirconyl acetate, zirconyl stearate, zirconyl octylate, germanium oxide, triphenylphosphite, tris(2,4-di-t-butylphenyl)phosphite, ethyltriphenylphosphonium bromide, triethylamine and triphenylamine.

No particular limitation is imposed on the monomers other than the polyhydric alcohol component including a propylene oxide adduct of bisphenol A and the monomer containing a sulfonic acid group. The acid component may be a usual polyvalent carboxylic acid. Examples of the polyvalent carboxylic acid include aromatic carboxylic acids such as terephthalic acid, isophthalic acid, phthalic acid anhydride, trimellitic acid anhydride, pyromellitic acid and naphthalenedicarboxylic acid, aliphatic carboxylic acids such as maleic acid anhydride, fumaric acid, succinic acid, alkenyl succinic acid anhydride and adipic acid, and alicyclic carboxylic acids such as cyclohexanedicarboxylic acid. One polyvalent carboxylic acid, or two or more polyvalent carboxylic acids may be used. It is preferable to use an aromatic carboxylic acid among these polyvalent carboxylic acids. It is preferable to use a trivalent or higher-valent carboxylic acid (e.g., trimellitic acid or anhydride thereof) together with dicarboxylic acid, so as to form a crosslinking structure or a branched structure to secure good fixability.

Also, examples of additional polyhydric alcohols other than the propylene oxide adduct of bisphenol A include aliphatic diols such as ethylene glycol, diethylene glycol, triethylene glycol, propylene glycol, butane diol, hexane diol, neopentyl glycol and glycerin, and alicyclic diols such as cyclohexane diol, cyclohexane dimethanol and hydrogenated bisphenol A. Only one additional polyhydric alcohol may be used, or two or more additional polyhydric alcohols may be used. Among these polyhydric alcohols, aromatic diols and alicyclic diols are preferable and aromatic diols are more preferable. A trivalent or higher valent polyhydric alcohol (e.g., glycerin, trimethylolpropane and pentaerythritol) may be used together with a diol, so as to form a crosslinking structure or a branched structure to secure good fixability.

Also, a monocarboxylic acid and/or a monoalcohol may be further added to the non-crystalline polyester obtained by polycondensation of a polyvalent carboxylic acid and a polyhydric alcohol so as to esterify a hydroxyl group and/or a carboxyl group at the terminal of the polymer and so as to adjust the acid value of the polyester resin. Examples of the monocarboxylic acid include acetic acid, acetic acid anhydride, benzoic acid, trichloroacetic acid, trifluoroacetic acid and propionic acid anhydride. Examples of the monoalcohol include methanol, ethanol, propanol, octanol, 2-ethylhexanol, trifluoroethanol, trichloroethanol, hexafluoroisopropanol and phenol.

As to the degree of coloration of the non-crystalline polyester resin in the invention, the resin has a Gardner color scale of preferably 3 or less, more preferably 2 or less and still more preferably 1 or less. The Gardner color scale is specified in JIS (Japanese Industrial Standards) K0071-2:98, the disclosure of which is incorporated herein by reference. When a non-crystalline polyester resin having a Gardner color scale of more than 3 is used as a toner resin, problems may be produced with respect to the qualities of the toner such as deterioration in the electrification properties of the toner, image unevenness, and a reduction in image strength. Moreover, when this toner is used as a full-color toner, problems may be produced concerning image qualities such as the color range of a fixed image and color reproducibility.

Even though a titanium catalyst is used in the invention, the Gardner color scale can be maintained at 3 or less owing to the presence of the copolymerized monomer containing a sulfonic acid group, as described above.

When the non-crystalline polyester resin in the invention is applied to an electrophotographic toner and is provided with low-temperature fixability, the non-crystalline polyester resin has a secondary transition temperature (Tg) of preferably 50° C. to 70° C. (more preferably 53° C. to 65° C.) and a softening point ((½) drop temperature in the measurement with a flow tester, Tm) of 90° C. to 120° C. (more preferably 100° C. to 115° C.). When the Tg is less than 50° C., problems may be created related to the use of the resin in the toner, such as reduction in image reliability, and degradation of powder properties (particularly, blocking of the toner and blocking of the fixed image). On the other hand, when the Tg is higher than 70° C., the fixing temperature is also increased to cause problems about low-temperature fixability. When the Tm is less than 90° C., the reliability of fixing may be lowered because offset (winding of paper around the fixing machine) is likely to occur in fixing. Also, when the Tm exceeds 120° C., the fixing temperature is also increased, and may cause problems about low-temperature fixability.

Here, the secondary transition temperature (Tg) is a value measured at a temperature increase rate of 3° C./min.

Also, the softening temperature (Tm) is a temperature corresponding to the midpoint between the flow-starting temperature and the flow-completion temperature in the measurement in which a 1 $cm^3$ sample is melted and allowed to flow out in an elevated flow tester (trade name: CFT-500, manufactured by Shimadzu Corporation) with a dice pore diameter of 1 mm at a pressure of 10 $kg/cm^2$ and a temperature increase rate of 3° C./min.

In a more preferred embodiment of the invention, the non-crystalline polyester resin comprises dodecenylsuccinic acid as a copolymerized polyvalent carboxylic acid monomer component in an amount of 1 mol % to 20 mol % (preferably 3 mol % to 15 mol %) based on all acid components of the non-crystalline polyester resin. It is possible to impart sufficient toughness to the resin and to achieve strong and tight adhesion of the fixed image to the sheet and bending resistance of the fixed image by copolymerizing dodecenyl succinic acid having a long side chain in an amount of 1 mol % to 20 mol % based on all acid components. On the other hand, when the amount of the dodecenylsuccinic acid to be copolymerized is less than 1 mol %, the effects produced by the use of dodecenylsuccinic acid may be insufficient. When the amount of the dodecenylsuccinic acid to be copolymerized exceeds 20 mol %, the toughness may be reduced by excessive internal plasticization of the resin.

The electrostatic image developing toner of the invention preferably contains a crystalline resin together with the non-crystalline polyester resin, so as to improve low-temperature fixability. In this case, the amount of the contained crystalline resin is preferably 3% by weight to 50% by weight based on the entire toner. If the content of the crystalline resin is less than 30% by weight, the effects produced by the use of the crystalline resin may be insufficient. If the content of the crystalline resin exceeds 50% by weight, the strength of the toner may be significantly impaired to cause the crushing of toner in the machine and/or to cause electrification problems such as leakage of charge through the crystalline resin.

There are various crystalline resins including polyolefin resins, polyamide resins and vinyl-based resins. Among them, crystalline polyester resins are preferable.

As the structural components of the crystalline polyester resin, aliphatic polyesters obtained by reacting aliphatic diols with aliphatic dicarboxylic acids (including acid anhydride and acid chlorides) are especially preferable.

The foregoing crystalline polyester resin is synthesized from a polyvalent carboxylic acid component and a polyhydric alcohol component. Examples of a divalent carboxylic acid component include aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid and 1,18-octadecanedicarboxylic acid, aromatic dicarboxylic acids such as dibasic acids (e.g., phthalic acid, isophthalic acid, terephthalic acid, naphthalene-2,6-dicarboxylic acid, malonic acid and mesaconic acid), and anhydrides or lower alkyl esters thereof. However, divalent carboxylic acids usable in the invention are not limited to these compounds.

Also, examples of a trivalent or higher valent carboxylic acid include 1,2,4-benzenetricarboxylic acid, 1,2,5-benzenetricarboxylic acid and 1,2,4-naphthalenetricarboxylic acid, and anhydrides and lower alkyl esters thereof. Only one polyvalent carboxylic acid may be used, or two or more polyvalent carboxylic acids may be used. Also, a dicarboxylic acid component having a sulfonic acid group is also usable as the acid component, in addition to the aforementioned aliphatic dicarboxylic acids and aromatic dicarboxylic acids. Examples of the dicarboxylic acid having a sulfonic acid group include, though not limited to, sodium 2-sulfoterephthalate, sodium 5-sulfoisophthalate and sodium sulfosuccinate.

Examples also include lower alkyl esters and anhydrides of these carboxylic acids.

Further, besides the above-mentioned aliphatic dicarboxylic acids and aromatic dicarboxylic acids, a dicarboxylic acid component having a double bond may be contained in the crystalline resin. Since molecules of the dicarboxylic acid having a double bond can be crosslinked using their double bonds by a radical reaction, the use of the dicarboxylic acid having a double bond is preferable for preventing hot offset at the fixing. Examples of such a dicarboxylic acid include maleic acid, fumaric acid, 3-hexenedioic acid, and 3-octenedioic acid. Examples also include lower alkyl esters and anhydrides of the above-mentioned dicarboxylic acids. Among these, fumaric acid, maleic acid, and the like are preferable.

As the polyhydric alcohol component in the crystalline polyester resin, aliphatic diols are preferable, and linear aliphatic diols whose main chain portions each have 2 to 20 carbons are more preferable. If the aliphatic diol has branching, the crystallinity of the polyester resin is degraded, and the melting point is lowered; therefore, the toner blocking resistance, image preservability, and low temperature fixability are likely to be deteriorated. In addition, if the number of carbons exceeds 20, it may be difficult to obtain materials suitable for practical use. The number of carbons is more preferably 14 or less.

Specific examples of the aliphatic diol preferable for the synthesis of a crystalline polyester include ethyleneglycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Examples of the trivalent or higher valent alcohol include glycerin, trimethylolethane, trimethylolpropane, and pentaerythritol. Only a single aliphatic diol may be used, or two or more aliphatic diols may be used simultaneously.

The electrostatic image developing toner of the invention comprises a non-crystalline polyester resin as a binder resin component, and preferably comprises a crystalline resin, and optionally comprises a colorant and a releasing agent.

The colorant is not particularly limited, and may be selected from known colorants. Examples thereof include: carbon black, such as furnace black, channel black, acetylene black, and thermal black; inorganic pigments, such as red oxide, Prussian blue, and titanium oxide; azo pigments, such as fast yellow, disazo yellow, pyrazolone red, chelate red, brilliant carmine, parabrown, and the like; phthalocyanine pigments, such as copper phthalocyanine and non-metal phthalocyanine; and condensed polycyclic pigments, such as flavanthrone yellow, dibromoanthrone orange, perylene red, quinacridone red, and dioxazine violet. Specific examples thereof include various pigments, such as chrome yellow, Hansa yellow, benzidine yellow, threne yellow, quinoline yellow, permanent orange GTR, pyrazolone orange, Vulcan orange, watchung red, permanent red, DUPONT oil red, lithol red, rhodamine B lake, lake red C, rose Bengal, aniline blue, ultramarine blue, CALCO oil blue, methylene blue chloride, phthalocyanine blue, phthalocyanine green, malachite green oxalate, pigment red 48:1, CI pigment red 122, CI pigment red 57:1, CI pigment yellow 12, CI pigment yellow 97, CI pigment yellow 17, CI pigment blue 15:1, and CI pigment blue 15:3. Only one colorant may be used, or two or more colorants may be used.

The releasing agent to be used is not particularly limited, and may be selected from known waxes. Examples thereof include: natural waxes such as carnauba wax, rice wax, and candelilla wax; synthetic, mineral, or petroleum waxes such as low-molecular weight polypropylene, low-molecular weight polyethylene, Sasol wax, microcrystalline wax, Fischer-Tropsch wax, paraffin wax, and Montan wax; ester-based waxes such as fatty acid esters and montanic esters. Only one releasing agent may be used, or two or more releasing agents may be used. The melting point of the releasing agent is preferably 50° C. or higher, and is more preferably 60° C. or higher, from the viewpoint of toner shelflife. Further, from the viewpoint of offset resistance, the melting point of the releasing agent is preferably 110° C. or lower, and is more preferably 100° C. or lower.

The toner of the invention for developing electrostatic images may further include, as necessary, various other substances, such as internal additives, charge controlling agents, inorganic particulate matter (inorganic particles), and organic particles. The internal additives may be selected from magnetic substances, and examples thereof include metals and alloys, such as ferrite, magnetite, reduced iron, cobalt, nickel, and manganese, and compounds comprising such metals. Examples of the charge controlling agents include quaternary ammonium chloride compounds, nigrosine compounds, dyes of complexes of aluminum, iron, chromium, or the like, and triphenylmethane pigments. The inorganic particulate matter is added mainly for the purpose of adjusting the viscoelasticity of the toner, and examples thereof include particles of silica, alumina, titania, calcium carbonate, magnesium carbonate, calcium phosphate, cerium oxide, and any other inorganic particles which are generally used as external additives for toner, such as those listed in detail later.

The electrostatic image developing toner of the invention is produced by the following method of producing an electrostatic image developing toner according to the invention.

The method of producing an electrostatic image developing toner according to the invention comprises: mixing a resin fine particle dispersion liquid containing one or more non-crystalline resins with a colorant dispersion liquid containing a colorant dispersed therein; allowing the resin fine particles and the colorant to aggregate to form aggregates having a toner particle diameter; and then heating the aggregates to fuse the components in each aggregate. At least one of the non-crystalline resin(s) is the aforementioned non-crystalline polyester resin.

Also, in the method of producing an electrostatic image developing toner, it is preferable to adhere at least one non-crystalline polyester resin to the surfaces of the aggregates after the formation of the aggregates, and then heat the aggregates to fuse the components in each aggregate.

As mentioned above, the electrostatic image developing toner of the invention comprises the non-crystalline polyester resin as a binder resin component, and preferably comprises a crystalline resin, and optionally comprises a colorant and the like. Specifically, it is possible to use a conventional kneading milling method, or a chemical method such as suspension polymerization method, emulsion polymerization aggregation method or dissolution suspension method. A chemical method is more preferable from the viewpoint of image quality, and an emulsion polymerization aggregation method is still more preferable because it has the best characteristics with respect to the particle size distribution.

In the production of toner by the emulsion polymerization aggregation method, the binder resin component is preferably used in the form of submicron particles having a particle diameter of about 1 μm or less in an aqueous emulsion or dispersion liquid. Examples of a method of producing an emulsion or dispersion liquid of the non-crystalline polyester resin (also a crystalline resin depending on the case) include a method in which the non-crystalline polyester resin (also a crystalline resin depending on the case) obtained by polymerization is emulsified or dispersed in water by applying high shear force using a usual surfactant such as sodium dodecylbenzenesulfonate and a polymer dispersant such as polyacrylic acid. The emulsifying and dispersing operation may be conducted under heating to a temperature that is higher than the melting point or glass transition temperature of the resin. Also, a usual method of producing resin fine particles may be used, such as a method in which phase-transition emulsification is conducted while the resin is dissolved by using a small amount of an organic solvent. For the emulsification that applies shearing force, an apparatus such as a ULTRATURRAX, CLEARMIX, Altimizer, Gaulin homogenizer, ultrasonic dispersing machine, planetary ball mill, microdisperser or Cabitron may be used.

When a radical-polymerizable non-crystalline polyester resin (also a crystalline resin depending on the case) is used, it is possible to apply a polymer heterogeneous polymerization method such as an emulsion polymerization method. It is also possible to use a method in which a polymer resin obtained by polymerization is dissolved in a radical-polymerizable vinyl monomer and the mixture is then emulsified and dispersed to polymerize the vinyl monomer, thereby producing resin fine particles. An example of the method is a mini-emulsion method. The invention is not limited at all with respect to the method for preparing a resin fine particle dispersion liquid.

Examples of usable surfactants include: anionic surfactants, such as a sulfuric acid ester salt, a sulfonic acid salt, and a phosphoric acid ester salt; cationic surfactants, such as an amine-salt-based surfactants and a quaternary-ammonium-salt-based surfactants; and nonionic surfactants, such as a polyethyleneglycol, an alkylphenolethyleneoxide adduct, and a polyhydric alcohol. Among these, anionic surfactants and cationic surfactants are preferable. It is preferable to use a nonionic surfactant together with an anionic surfactant or with a cationic surfactant. Only one surfactant may be used, or two or more surfactants may be used in combination. Examples of anionic surfactants include sodium dodecylbenzenesulfonate, sodium alkylnaphthalenesulfonate, sodium arylalkylpolyethersulfonate, sodium 3,3-disulfonediphenylurea-4,4-diazo-bis-amino-8-naphthol-6-sulfonate, orthocarboxybenzene-azo-dimethylaniline, sodium 2,2,5,5-tetramethyl-triphenylmethane-4,4-diazo-bis-β-naphthol-6-sulfonate, sodium dialkylsulfosuccinate, sodium dodecylsulfate, sodium tetradecylsulfate, sodium pentadecylsulfate, sodium octylsulfate, sodium oleate, sodium lauriate, sodium capriate, sodium caprylate, sodium capronate, potassium stearate, and calcium oleate. Examples of cationic surfactants include alkylbenzendimethylammonium chloride, alkyltrimethylammonium chloride, and distearylammonium chloride. Examples of nonionic surfactants include polyethyleneoxide, polypropyleneoxide, a combination of polypropyleneoxide and polyethyleneoxide, an ester of polyethyleneglycol and a higher fatty acid, alkylphenolpolyethyleneoxide, an ester of a higher fatty acid and polyethyleneglycol, an ester of a higher fatty acid and polypropyleneoxide, and a sorbitan ester.

In addition, in order to prevent the Ostwald ripening phenomenon in the mini-emulsion method, a higher alcohol, represented by heptanol or octanol, or a higher aliphatic hydrocarbon, represented by hexadecane, is often compounded as a stabilization assistant agent.

The emulsion stabilizer may be selected from the above-mentioned nonionic surfactants.

It is effective to control the pH value of the emulsion at the emulsification of the resin so as to further provide the stability of the resin particles. For adjustment of the pH of the resin, an acid or an alkali can be used. This pH is preferably in a range of pH 7±2. If the acidity or alkalinity is too high, there is a possibility of the hydrolysis of the resin. Usable pH adjusters include a water soluble acid or alkali. Examples thereof include hydrochloric acid, sulfuric acid, nitric acid, acetic acid, perchloric acid, carbonic acid, sodium hydroxide, potassium hydroxide, ammonium hydroxide, calcium hydroxide, and magnesium hydroxide.

Next, the method of the invention for producing a toner for developing an electrostatic latent image involving emulsion polymerization aggregation is described. In the method, the toner is obtained by, for example: mixing an emulsion containing the non-crystalline polyester resin with a dispersion of the colorant particles and a dispersion of the releasing agent particles, and then adding another ionic surfactant having the polarity opposite to that of the above-mentioned ionic surfactant, thereby causing hetero aggregation to form aggregated particles having the toner diameter (aggregation process); and then heating the particles to a temperature that is the glass transition point of the resin particles or higher, thereby fusing and coalescing components in each aggregated particle (fusion process); and then cleaning and drying the obtained particles (drying process). Preferable range of the shape of the toner ranges from an amorphous shape to a spherical shape. As the aggregation agent, an inorganic salt or a bi-or higher valent metal complex are also preferable, in addition to the surfactant having an opposite polarity to that of the surfactant used in the emulsion. It is particularly preferable to use the metal complex since the amount of the surfactant can be reduced and since the charging property can be improved.

In an embodiment, in the initial stage of the aggregation process, in which the emulsion, the dispersion of the colorant particles, and the dispersion of the releasing agent particles are mixed, the balance of the amounts of the ionic dispersants of the respective polarities is shifted beforehand; and then an inorganic metal salt polymer, such as polyaluminum chloride, is added to achieve ionic neutralization; thereafter, primary aggregated particles of the first stage is formed and stabilized at a temperature that is not higher than the glass transition point; and then, a dispersion of second resin particles is added which has been treated with an ionic dispersant of such a polarity and amount as to compensate for the shift in ionic balance as a second stage; and then, as required, the liquid is slightly heated to a temperature that is not higher than the glass transition point of the resins contained in the primary aggregated resin particles and the second resin particles so as to stabilize the particles at a higher temperature; and then the liquid is heated to a temperature that is the glass transition point or higher so as to cause the second resin particles to be adhered to the primary aggregated particles, thereby achieving coalescence. Further, this stepwise operation for aggregation may be repeated several times. This two-stage method is effective for improving the degree of encapsulation of the releasing agent and the colorant.

As the aggregation agent, a bi- or higher valent metal complex is preferable, in addition to the surfactant having the opposite polarity to that of the surfactant used as the dispersant, and the inorganic metal salt. Examples of the inorganic metal salt include: metal salts, such as calcium chloride, calcium nitrate, barium chloride, magnesium chloride, zinc chloride, aluminum chloride, and aluminum sulfate; and inorganic metal salt polymers, such as polyaluminum chloride, polyaluminum hydroxide, and calcium polysulfide. Among these, aluminum salts and polymers thereof are preferable. In order to obtain a sharper particle size distribution, the valency of the inorganic metal salt may be monovalent, preferably divalent, more preferably trivalent, still more preferably tetravalent, and an inorganic metal salt polymer is more preferable than a non-polymeric inorganic metal salt provided that their valence numbers are the same.

In the fusion process, under stirring as in the aggregation process, the pH value of the suspension of the aggregated particles is set within a range of 6.5 to 8.5 to stop the progress of the aggregation, and then the liquid is heated to a temperature that is not lower than the glass transition point of the binder resin to coalesce the aggregated particles.

The heating temperature at fusion is not particularly limited as long as the temperature is not lower than the glass transition point of the binder resin contained in the aggregated particle. The heating time may be such a time that the surface of the aggregated particles is smoothened by fusion during the heating time, and may be about 0.5 to 1.5 hour. If the heating time is too long, the crystalline polyester contained in the core aggregated particle tends to be exposed on the toner surface. The exposure of the crystalline polyester is effective for fixability and document shelflife, but has an adverse effect on the charging characteristic, thus exposure of the crystalline polyester on the toner surface is not preferable.

Toner particles are obtained by further subjecting the fused particles obtained by fusion to solid-liquid separation process involving filtration or the like, and as required, to a cleaning process and/or a drying process. In order to secure a sufficient charging characteristic and reliability as a toner, it is preferable to clean the fused particles sufficiently with deionized water in the cleaning process.

In the drying process, any method, such as an ordinary vibration-type fluidization drying method, a spray drying method, a freeze drying method, or a flash jet drying method, may be adopted. The water content of the toner after drying may be 1.0% or less, preferably 0.5% or less.

To the toner particles produced through the drying process as described above, various known external additives, such as the inorganic particles and organic particles described above, can be added as other components in accordance with the purpose.

Examples of the inorganic particles as an external additive include particles of silica, alumina, titanium oxide, barium titanate, magnesium titanate, calcium titanate, strontium titanate, zinc oxide, silica sand, clay, mica, wollastonite, diatomaceous earth, cerium chloride, red oxide, chrome oxide, cerium oxide, antimony trioxide, magnesium oxide, zirconium oxide, silicon carbide, and silicon nitride. Among them, silica particles and titanium oxide particles are preferable, and inorganic particles which have been subjected to a hydrophobicity-imparting treatment are particularly preferable. Inorganic particles are used generally for the purpose of improving the fluidity. Organic particles are used generally for the purpose of improving the cleanability and transferability, and specific examples include polystyrene, polymethyl methacrylate, and polyvinylidene fluoride.

When the toner of the present invention is used as a magnetic toner, it may contain a magnetic powder in the binder resin. The magnetic powder may be a substance which is magnetized in magnetic fields. Specifically, the material for the magnetic powder may be a ferromagnetic substance, such as iron, cobalt, or nickel, or a compound, such as ferrite or magnetite. In particular, in the present invention, since the toner is obtained in the aqueous layer, it is necessary to pay attention to the migration of the magnetic substance to the aqueous layer; accordingly, it is preferable to perform a surface modification, such as a hydrophobicity-imparting treatment, on the magnetic powder before use.

<Developer for Electrostatic Image>

The toner of the present invention for developing an electrostatic image may be used as a one-component developer as it is, or may be used in a two-component developer. When the toner is to be used in a two-component developer, it is mixed with a carrier to form a two-component developer.

The carrier usable in the two-component developer is not particularly limited, and any known carrier can be used. Examples thereof include: magnetic metals, such as iron oxide, nickel, and cobalt; magnetic oxides, such as ferrite and magnetite; resin coated carriers each having a resin coating layer on the surface of a core material selected from the above magnetic substances; and magnetic dispersion type carriers. The carrier may also be a resin dispersion carrier in which an electrically conductive material or the like is dispersed in a matrix resin.

Examples of the coating resin or matrix resin usable in the carrier include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin comprising organosiloxane bonds or a modified product thereof; a fluororesin, a polyester, a polycarbonate, a phenolic resin, and an epoxy resin.

Examples of the electrically conductive material include metals such as gold, silver, and copper; carbon black; and titanium oxide, zinc oxide, barium sulfate, aluminum borate, potassium titanate, tin oxide, and carbon black.

Examples of the core material of the carrier include: magnetic metals, such as iron, nickel, and cobalt; magnetic oxides, such as ferrite and magnetite; and a glass bead. The core material is preferably a magnetic substance when the carrier is used in the magnetic brush method. The volume-average particle diameter of the core material of the carrier is preferably 10 to 500 μm, and is more preferably 30 to 100 μm.

In order to coat the surface of the core material of the carrier with a resin, a coating liquid for forming the resin layer containing the resin and other optional additives dissolved in an appropriate solvent can be applied to form a coated layer. The solvent is not particularly limited, and may be selected as appropriate in consideration of the coating resin to be used, suitability for coating, and the like.

Specific examples of the resin coating method include: the immersion method in which the core material of the carrier is immersed in the coating liquid; the spray method in which the coating liquid is sprayed onto the surface of the core material of the carrier; the fluidized bed method in which the coating liquid is sprayed onto the core material of the carrier that is floated by fluidizing air; and the kneader coater method in which the core material of the carrier is mixed with the coating liquid in the kneader coater and the solvent is removed. The mixing ratio (the ratio by mass) of the toner of the present invention to the above-mentioned carrier in the two-component developer is preferably in the range of about 1:100 (toner to carrier) to 30:100, and is more preferably in the range of about 3:100 to 20:100.

<Image Forming Method>

The image forming method of the invention comprises forming an electrostatic latent image on the surface of a latent image holding member (latent image forming process); developing the electrostatic latent image formed on the surface of the latent image holding member with a developer containing a toner to form a toner image (developing process); transferring the toner image formed on the surface of the latent image-holding member onto the surface of an image receiving member (transfer process); and thermally fixing the toner image transferred onto the surface of the image receiving member (fixing process), wherein the toner is the toner of the invention for developing an electrostatic latent image.

The developer may be a one-component developer or a two-component developer. Each process may be known in the field of image forming methods. In addition, the image forming method may further comprise processes other than the above processes.

The latent image holding member may be, for example, an electrophotographic photoreceptor or a dielectric recording element. In the case of an electrophotographic photoreceptor, the surface thereof is uniformly charged by a corotron charger, a contact charger, or the like, then the surface is exposed to light to form an electrostatic latent image (latent image forming process). Then, the electrophotographic photoreceptor is brought into contact with or proximity to a developing roller having a developer layer on its surface so as to allow toner particles to adhere to the electrostatic latent image, thereby forming a toner image on the electrophotographic photoreceptor (the developing process). The toner image formed is transferred to the surface of an image receiving member, such as a sheet of paper, by using a corotron charger or the like (the transfer process). Further, the toner image transferred onto the surface of the image receiving member is thermally fixed with a fuser, whereby a final toner image is formed.

In the thermal fixing by the fuser, a releasing agent is usually supplied to a fixing member of the fuser in order to prevent occurrence of offset and the like.

In the toner of the present invention (including the toner in a two-component developer; the scope of the term "toner" includes the toner in a two-component system hereinafter), when the binder resin has a crosslinking structure, an excellent releasability is obtained owing to the effect caused by the crosslinking structure, and thus fixing can be carried out with a releasing agent in a reduced amount or carried out without a releasing agent.

It is preferable not to use the releasing agent supplied to the fixing member from the viewpoint of the elimination of the adherence of oil to the image and image receiving member after fixing. However, when the amount of supplied releasing agent is 0 mg/cm$^2$, the abrasion loss of the fixing member upon contact of the fixing member with the image receiving member such as a sheet of paper at fixing is increased, whereby the durability of the fixing member is likely to be lowered. Accordingly, it is preferable to supply a trace amount of releasing agent to the fixing member in a range of $8.0\times10^{-3}$ mg/cm$^2$ or less, in accordance with the necessity.

When the amount of the releasing agent supplied to the fixing member exceeds $8.0\times10^{-3}$ mg/cm$^2$, the image quality is likely to be impaired owing to the releasing agent adhered to the image surface after fixing, and this adverse effect can be especially remarkable when a transmitted light is used as in the case of an OHP. In addition, the releasing agent may heavily adhere to the image receiving member, making the image receiving member sticky. Further, an increased supply amount of releasing agent requires a larger volume of the reservoir that stores the releasing agent, whereby the size of the fixing apparatus may increase.

The releasing agent to be supplied to the fixing member is not particularly limited, and preferable examples thereof include liquid releasing agents, such as dimethyl silicone oil, fluorine oil, fluorosilicone oil, and modified oils (e.g., amino-modified silicone oils). Among these, modified oils such as amino-modified silicone oils are excellent in coatability on the fixing member, thus preferable from the viewpoint of the formation of a uniform releasing agent layer by adsorption onto the surface of the fixing member. In addition, from the viewpoint of the formation of a uniform releasing agent layer, fluorine oils and fluorosilicone oils are preferable.

In a conventional image forming method that does not use the toner of the present invention, it is not practical, from the viewpoint of cost, to use a fluorine oil or fluorosilicone oil as the releasing agent to be supplied to the fixing member since a significant amount of the releasing agent has to be supplied to the fixing member. However, when the electrophotographic toner of the present invention is used, the supply amount of the releasing agent can be greatly reduced, so that the use of a fluorine oil or fluorosilicone oil as the releasing agent does not cause practical problems.

The method for supplying the releasing agent to the surface of the roller or belt (the fixing member) for heating and pressure fixing is not particularly limited, and examples thereof include the pad method which uses a pad impregnated with a liquid releasing agent, the web method, the roller method, and the non-contact-type shower method (the spray method). Among them, the web method and the roller method are preferable. These methods are preferable since the releasing agent can be supplied uniformly, and since the supply amount can be controlled easily. In order to uniformly supply the releasing agent to the entire fixing member by using the shower method, it is necessary to further use a blade or the like.

The amount of the releasing agent supplied to the fixing member can be measured as follows. Specifically, when a sheet of plain paper for a general copying machine (typically a copying paper manufactured by Fuji Xerox Co., Ltd., having a tradename of J Paper) is allowed to pass the fixing member whose surface is supplied with the releasing agent, the releasing agent adheres to the sheet of plain paper. Then the adhered releasing agent is extracted by using a Soxhlet extractor, in which hexane is used as the solvent.

By determining the amount of the releasing agent contained in the hexane with an atomic absorption analyzer, the amount of the releasing agent adhered to the sheet of plain paper can be determined. This amount is defined as the amount of the releasing agent supplied to the fixing member.

Examples of the image receiving member (the recording material) that receives the transferred toner image include plain paper, an OHP sheet, and the like for electrophotographic copying machines, printers, and the like. In order to improve the smoothness of the post-fixing image surface, it is preferable to use an image receiving member having smoother surface. For example, the image receiving member may be a coated paper comprising plain paper coated with a resin or the like, an art paper for printing, or the like.

Because the image forming method of the present invention uses the developer of the invention (the toner of the invention), low-temperature fixing is realized, and the toner can retain an adequate quantity of electricity derived from friction. Therefore, the image forming method of the invention is excellent in energy saving, and capable of forming a superior image while preventing the occurrence of scattering of the toner or the like.

EXAMPLES

In the following, the invention will be explained in detail by reference to examples. The crystalline resin compositions, the amount, and the characteristics of the developer in Examples are collectively described in Table 1. However, these Examples should not be construed as limiting the invention.

1. Synthesis of Non-crystalline Polyester Resin and Preparation of Dispersion Liquid Thereof <Preparation of a Non-crystalline Polyester Resin (1)>

(Polyvalent Carboxylic Acid Monomer)

Terephthalic acid: 30 mol %

Fumaric acid: 69 mol %

Sodium 5-isophthalic acid sulfonate: 1 mol % (0.5 mol % based on the entire resin)

(Polyhydric Alcohol Component)

Ethylene oxide (2 mol) adduct of bisphenol A: 34 mol %

Propylene oxide (2 mol) adduct of bisphenol A: 66 mol %

The polyvalent carboxylic acid monomers and polyhydric alcohols in a total amount of 3 kg is put in a 5L (inside volume) flask equipped with a stirrer, a nitrogen introduction tube, a temperature sensor and a rectifying column, and the temperature of the mixture is raised up to 190° C. over one hour. After it is confirmed that the reaction system is uniformly stirred, a catalyst Ti $(OBu)_4$ (0.003% by weight based on the total amount of the polyvalent carboxylic acid monomers) is poured into the mixture.

The temperature of the mixture is raised from that temperature to 240° C. over 6 hours and a dehydration condensation reaction is continued at 240° C. for another 6 hours to perform polymerization, thereby generating a non-crystalline polyester resin (1). The molecular weight of the obtained non-crystalline polyester resin (1) is measured by GPC (trade name: HLC-8 120 GPC, manufactured by Tosoh Corporation, based on a styrene standard material), and the weight average molecular weight of the polyester resin (1) is found to be 9800. The thermal characteristics of the resin are measured by a differential scanning calorimeter (trade name: DSC-50, manufactured by Shimadzu Corporation, temperature increase rate: 3° C./min), with the result that the resin has a Tg (secondary transition temperature) of 60° C. Also, the softening temperature of the obtained resin ((½) drop temperature in the measurement with a flow tester, Tm) is measured as a temperature corresponding to the midpoint between the flow-starting temperature and the flow-completion temperature in the measurement in which a 1 $cm^3$ sample is melted and allowed to flow out in an elevated flow tester (trade name: CFT-500, manufactured by Shimadzu Corporation) with a dice pore diameter of 1 mm at a pressure of 10 $kg/cm^2$ and a temperature increase rate of 3° C./min. As a result, Tm is found to be 110° C. Also, the obtained resin is sandwiched between slide glasses by a metal clip, using a stainless spacer such that the thickness of the resin becomes about 500 μm. Then, the resin is melted under heating on a hot plate to measure the Gardner color scale of the resin by visual comparison using the Gardner color scale standard solutions prescribed in JIS K0071-2:98. As a result, the Gardner color scale of the resin is found to be 1.

<Preparation of a Dispersion Liquid of Non-crystalline Polyester Resin (1)>

Then, the obtained non-crystalline polyester resin (1) is conveyed to a CABITRON CD1010 (manufactured by Eurotech) in a molten state at a rate of 100 g/min. An aqueous 0.37 wt % dilute ammonia water prepared by diluting reagent aqueous ammonia with ion exchange water is poured into a separately-prepared aqueous medium tank. The aqueous dilute ammonia is transferred to the CABITRON CD 1010 (manufactured by Eurotech) at a rate of 0.1 l/min while heated to 160° C. by a heat exchanger at the same time the polyester resin (1) in a molten state is transferred to the CABITRON CD1010. The CABITRON CD1010 is operated at a rotator rotating speed of 60 Hz and a pressure of 5 kg/cm$^2$, to obtain a dispersion liquid of a non-crystalline polyester resin (1) having a volume average particle diameter of 160 μm (the average particle diameters described below refer to volume average particle diameters unless otherwise specified) and a solid content of 30% by weight.

<Preparation of a Non-crystalline Polyester Resin (2)>

A non-crystalline polyester resin (2) is produced in the same manner as the preparation of the non-crystalline polyester resin (1) except that the polyvalent carboxylic acid monomer and the polyhydric alcohol component are changed to the following compounds.

(Polyvalent Carboxylic Acid Monomer)

Terephthalic acid: 30 mol %

Fumaric acid: 60 mol %

Sodium 5-isophthalic sulfonate: 10 mol % (5 mol % based on the entire resin)

(Polyhydric Alcohol component)

Propylene oxide (2 mol) adduct of bisphenol A: 100 mol %

The properties of the non-crystalline polyester resin (2) are measured in the same manner as in the case of the non-crystalline polyester resin (1). As a result, the non-crystalline polyester resin (2) is found to have a weight average molecular weight of 10300, a Tg of 65° C., a Tm of 118° C. and a Gardner color scale of 3.

<Preparation of a Dispersion Liquid of the Non-crystalline Polyester Resin (2)>

Then, a dispersion liquid of a non-crystalline polyester resin (2) having an average particle diameter of 150 μm and a solid content of 30% by weight is prepared in the same manner as the preparation of the dispersion liquid of the non-crystalline polyester resin (1).

<Preparation of Non-crystalline Polyester Resin (3)>

A non-crystalline polyester resin (3) is prepared in the same manner as the preparation of the non-crystalline polyester resin (1), except for changing the polyvalent carboxylic acid monomers and polyhydric alcohol components to the following compounds.

| (Polyvalent Carboxylic Acid Monomer) | |
|---|---|
| Terephthalic acid: | 30 mol % |
| Fumaric acid: | 48 mol % |
| Sodium 5-sulfoisophthalate: | 20 mol % (10 mol % based on the entire resin) |
| Dodecenyl succinic acid anhydride: | 2 mol % |
| (Polyhydric Alcohol Component) | |
| Bisphenol A propylene oxide (2 mol) adduct: | 100 mol % |

The physical properties of the obtained non-crystalline polyester resin (3) are measured in the same manner as in the case of the non-crystalline polyester resin (1). As a result, the non-crystalline polyester resin (3) is found to have a weight average molecular weight of 10600, a Tg of 63° C., a Tm of 115° C., and a Gardner color scale of 2.

<Preparation of Dispersion of Non-crystalline Polyester Resin (3)>

A dispersion of the non-crystalline polyester resin (3) is prepared from the obtained non-crystalline polyester resin (3) in the molten state, in the same manner as in the preparation of the dispersion of the non-crystalline polyester resin (1). The dispersion of the non-crystalline polyester resin (3) has a solid content of 30% by weight and contains particles having an average particle diameter of 155 μm.

<Preparation of Non-Crystalline Polyester Resin (4)>

A non-crystalline polyester resin (4) is prepared in the same manner as the preparation of the non-crystalline polyester resin (1), except for changing the polyvalent carboxylic acid monomers and polyhydric alcohol components to the following compounds.

| (Polyvalent Carboxylic Acid Monomer) | |
|---|---|
| Terephthalic acid: | 30 mol % |
| Fumaric acid: | 40 mol % |
| Sodium 5-sulfoisophthalate: | 30 mol % (15 mol % based on the entire resin) |
| (Polyhydric Alcohol Component) | |
| Bisphenol A propylene oxide (2 mol) adduct: | 100 mol % |

The physical properties of the obtained non-crystalline polyester resin (4) are measured in the same manner as in the case of the non-crystalline polyester resin (1). As a result, the non-crystalline polyester resin (4) is found to have a weight average molecular weight of 9000, a Tg of 59° C., a Tm of 105° C., and a Gardner color scale of 2.

<Preparation of Dispersion of Non-crystalline Polyester Resin (4)>

A dispersion of the non-crystalline polyester resin (4) is prepared from the obtained non-crystalline polyester resin (4) in the molten state, in the same manner as in the preparation of the dispersion of the non-crystalline polyester resin (1). The dispersion of the non-crystalline polyester resin (4) has a solid content of 30% by weight and contains particles having an average particle diameter of 145 μm.

<Preparation of Non-Crystalline Polyester Resin (5)>

A non-crystalline polyester resin (5) is prepared in the same manner as the preparation of the non-crystalline polyester resin (1), except for changing the polyvalent carboxylic acid monomers and polyhydric alcohol components to the following compounds.

| (Polyvalent Carboxylic Acid Monomer) | |
|---|---|
| Terephthalic acid: | 60 mol % |
| Fumaric acid: | 20 mol % |
| Sodium 5-sulfoisophthalate: | 10 mol % (5 mol % based on the entire resin) |
| Dodecenyl succinic acid anhydride: | 10 mol % |
| (Polyhydric Alcohol Component) | |
| Bisphenol A propylene oxide (2 mol) adduct: | 100 mol % |

The physical properties of the obtained non-crystalline polyester resin (5) are measured in the same manner as in the case of the non-crystalline polyester resin (1). As a result, the non-crystalline polyester resin (5) is found to have a weight average molecular weight of 10100, a Tg of 55° C., a Tm of 95° C., and a Gardner color scale of 2.

<Preparation of Dispersion of Non-crystalline Polyester Resin (5)>

A dispersion of the non-crystalline polyester resin (5) is prepared from the obtained non-crystalline polyester resin (5) in the molten state, in the same manner as in the preparation of the dispersion of the non-crystalline polyester resin (1). The dispersion of the non-crystalline polyester resin (5) has a solid content of 30% by weight and contains particles having an average particle diameter of 148 μm.

<Preparation of Non-Crystalline Polyester Resin (6)>

A non-crystalline polyester resin (6) is prepared in the same manner as the preparation of the non-crystalline polyester resin (1), except for changing the polyvalent carboxylic acid monomers and polyhydric alcohol components to the following compounds.

| (Polyvalent Carboxylic Acid Monomer) | |
|---|---|
| Terephthalic acid: | 60 mol % |
| Fumaric acid: | 40 mol % |
| (Polyhydric Alcohol Component) | |
| Bisphenol A propylene oxide (2 mol) adduct: | 100 mol % |

The physical properties of the obtained non-crystalline polyester resin (6) are measured in the same manner as in the case of the non-crystalline polyester resin (1). As a result, the non-crystalline polyester resin (6) is found to have a weight average molecular weight of 9000, a Tg of 67° C., a Tm of 125° C., and a Gardner color scale of 4.

<Preparation of Dispersion of Non-crystalline Polyester Resin (6)>

A dispersion of the non-crystalline polyester resin (6) is prepared from the obtained non-crystalline polyester resin (6) in the molten state, in the same manner as in the preparation of the dispersion of the non-crystalline polyester resin (1). The dispersion of the non-crystalline polyester resin (6) has a solid content of 30% by weight and contains particles having an average particle diameter of 184 μm.

2. Synthesis of a Crystalline Polyester Resin and Preparation of Dispersion Liquid of the Resin <Preparation of a Crystalline Polyester Resin (7)>

10 mol of 1,9-nonanediol, 10 mol of 1,10-dodecanediacid and a catalyst $Ti(OBu)_4$ (0.014% by weight based on the acid component) are put in a three-neck flask. Then, the internal pressure of the flask is reduced, and the atmosphere is changed to an inert gas atmosphere by using nitrogen gas. The mixture is refluxed at 180° C. for 6 hours under mechanical stirring. Thereafter, unreacted monomers are removed by distillation under reduced pressure, and the temperature of the residue is raised gradually to 220° C. The residue is stirred for 12 hours, and is sampled when the residue becomes viscous. A crystalline polyester resin (7) is obtained in this way. The obtained crystalline polyester resin (7) is subjected to GPC (trade name: HLC-8 120 GPC, manufactured by Tosoh Corporation, based on a styrene standard material), and its weight average molecular weight is found to be 18000. Also, the thermal characteristics of the resin are measured by a differential scanning calorimeter (trade name: DSC-50, manufactured by Shimadzu Corporation, temperature increase rate: 3° C./min). As a result, the melting point of the resin is found to be 75° C.

<Preparation of Crystalline Polyester Resin (7)>

Next, the crystalline polyester resin (7) is used to prepare a resin fine particle dispersion liquid.

| | |
|---|---|
| Crystalline polyester resin (7): | 90 parts by weight |
| Ionic surfactant (trade name: NEOGEN RK, manufactured by Dai-ichi Kogyo Seiyaku Co., Ltd.): | 1.8 parts by weight |
| Ionic exchange water: | 210 parts by weight |

The above mixture is heated to 100° C., and subjected to a sufficient dispersing treatment using ULTRATURRAX T50 manufactured by IKA. Then, the mixture is subjected to another dispersing treatment using a pressure discharge type Gholin homogenizer for one hour to obtain a dispersion liquid of the crystalline polyester resin (7) having an average particle diameter of 200 nm and a solid content of 30% by weight.

| 3. Preparation of a releasing agent dispersion liquid | |
|---|---|
| Ester wax (WE-2, manufactured by Nippon Oil & Fats Co., Ltd., having a melting point of 65° C.): | 50 parts by weight |
| Anionic surfactant (NEOGEN RK, Dai-ichi Kogyo Seiyaku Co., Ltd.): | 5 parts by weight |
| Ion exchange water: | 200 parts by weight |

The above mixture is heated to 95° C. and subjected to a dispersing treatment using a homogenizer (trade name: ULTRATURRAX T50, manufactured by IKA). Then, the mixture is subjected to another dispersing treatment using Manton Gholin high-pressure homogenizer (Gholin) to give a releasing agent dispersion liquid (with a concentration of the releasing agent of 20% by weight) containing releasing agent particles having an average particle diameter of 230 nm dispersed therein.

| 4. Preparation of colorant dispersion liquid | |
|---|---|
| Cyan pigment (Pigment Blue 15:3 (copper phthalocyanine), manufactured by Dainichiseika Color & Chemicals Mfg. Co., Ltd.): | 100 parts by weight |
| Anionic surfactant (NEOGEN R, Dai-ichi Kogyo Seiyaku Co., Ltd.): | 15 parts by weight |
| Ion exchange water: | 900 parts by weight |

The above components are mixed, and the mixture is subjected to a dispersing treatment for about one hour using a high-pressure impact type dispersing machine Altimizer (trade name: HJP30006, manufactured by Sugino Machine Limited), to give a colorant dispersion liquid containing colorant (cyan pigment) particles dispersed therein. In the colorant dispersion liquid, the average particle diameter of the colorant particles is 0.15 μm, and the concentration of the colorant particles is 23% by weight.

Example 1

| [Preparation of toner particles (1)] | |
|---|---|
| Non-crystalline polyester resin dispersion liquid (1): | 800 parts by weight (solid content: 240 parts by weight) |
| Colorant dispersion liquid: | 22.87 parts by weight (solid content: 5.3 part by weight) |
| Releasing agent dispersion liquid: | 50 parts by weight (solid content: 10 parts by weight) |
| Nonionic surfactant (IGEPAL CA897): | 0.5 part by weight |

The above raw materials except for 224 parts by weight (solid content: 67 part by weight) of the non-crystalline polyester resin (1) are put in a 5 L cylindrical stainless container. The components in the container are subjected to dispersing and mixing treatment for 30 minutes by ULTRATURRAX at 8000 rpm while shear force is applied. Then, 0.14 part by weight of an aqueous 10% nitric acid solution of aluminum polychloride as a coagulant is added dropwise to the mixture. During the addition of the coagulant, the pH value of the raw material dispersion liquid is adjusted within a range of 4.2 to 4.5. 0.3N nitric acid or an aqueous 1N sodium hydroxide solution is added as necessary to adjust the pH value of the liquid. Thereafter, the raw dispersion liquid is transferred to a polymerization kettle equipped with a stirrer and a temperature gauge, and then heated to promote the growth of the aggregated particles at 40° C. When the volume average particle diameter is increased to 5.0 μm, the remaining 224 parts by weight of the non-crystalline polyester resin (1) is gradually added to the dispersion liquid. The dispersion liquid is then heated to 50° C. to form particles having a particle diameter of 6.0 μm. The pH of the dispersion liquid is raised to 9.0 and then the temperature of the liquid is raised to 95° C., and the liquid is kept at 95° C. for 6 hours. Then, the pH of the dispersion liquid is gradually decreased to 6.5, and heating is stopped. Thereafter, the dispersion liquid is allowed to cool. Thereafter, the resulting particles are allowed to pass through a 45 μm-mesh screen and washed with water repeatedly, followed by drying by a freeze drier to obtain toner particles (1). The volume average particle diameter of the final toner particles is measured by a Coulter Counter (trade name: TA-II model, manufactured by Coulter Company, aperture diameter: 50 μm), and found to be 6.1 μm. The distribution of volume average particle diameter is found to be 1.21. The content of titanium contained in the dried toner is measured by fluorescent X-rays using a separately-determined calibration curve, and found to be 10 ppm.

[Preparation and Evaluation of an Electrostatic Image Developer (1))

1 part of colloidal silica (trade name: R972, manufactured by Nippon Aerosil Co., Ltd.) is added externally to 100 parts of the obtained toner particles (1) and these components are mixed by a Henshel Mixer to obtain electrostatic image developing toner (1).

Separately, 100 parts of ferrite particles (manufactured by Powdertech, average particle diameter: 50 μm), 1 part of a methylmethacrylate resin (manufactured by Mitsubishi Rayon Co., Ltd., molecular weight: 95000), and 500 parts of toluene are put in a pressure kneader and mixed at ambient temperature for 15 minutes. Then, the temperature of the mixture is raised to 70° C. under reduced pressure and mixing operation to remove toluene, and then the residue is cooled. The resultant particles are sieved through a 105 μm screen to give a ferrite carrier (resin coated carrier). This ferrite carrier is mixed with the electrostatic image developing toner (1) to give a two-component electrostatic image developer (1) having a toner concentration of 7% by weight. The absolute value of the charge quantity (μC/g) of this electrostatic image developer under the environment of 80% RH and 28° C. is measured by a blow-off coulometer for evaluation. As a result, the developer is found to have a superior initial toner charge quantity of −42 μC/g. Also, the charge quantity of the toner is measured after the toner is stored in the same environmental condition for one week. The charge quantity after storage was 94% of the initial charge quantity. This results indicates good charge retaining property of the developer.

Moreover, for the evaluation of the fixability and image quality of the developer, images are formed using a modified DOCU CENTRE COLOR 500CP manufactured by Fuji Xerox Co., Ltd. Evaluation on fixing temperature, initial image quality, and image quality after printing on 10000 copies is conducted. Specifically, the fixing temperature is measured using an external fixing machine whose fixing temperature is variable. Also, the image quality is evaluated visually with respect to image characteristics including the particle size distribution of the toner, scattering of the toner which is an image defect caused by inferior charging characteristics (initial electrification and electrification deterioration) of the toner, image density, and image density unevenness. As a result, the fixing temperature is found to be 118° C., indicating that the toner is fixable at a lower temperature than the fixing temperatures of conventional toners. Also, scattering of the toner is not observed, and uniform images with satisfactory image density are obtained. Thus, the developer is found to have superior image quality sufficient for practical use. The image characteristics described in Table 1 are evaluated according to the following criteria.

The image recording by the modified DOCU CENTRE COLOR 500CP involves a latent image forming process, a developing process, a transferring process, and a fixing process.

(Criteria of Evaluation of Image Characteristics)

A: Scattering of the toner is not observed, and uniform images with sufficient image density are obtained.

B: Although slight scattering of the toner and slight image unevenness are observed, image characteristics are practically acceptable.

C: Scattering of the toner and image quality unevenness are observed, and image characteristics are practically unacceptable.

Example 2

[Preparation of Toner Particles (2)]

Toner particles (2) are produced in the same manner as the preparation of the toner particles (1) in Example 1 except that 672.1 parts by weight of the non-crystalline polyester resin dispersion liquid (2) is used in place of 800 parts by weight of the non-crystalline polyester resin dispersion liquid (1) and that 127.9 parts by weight of the crystalline polyester resin dispersion liquid (7) is further used. The volume average particle diameter of the final toner particles is measured by a Coulter Counter (trade name: TA-II model, manufactured by Coulter Company, aperture diameter: 50 μm), and found to be 5.8 μm. The volume average particle diameter distribution was found to be 1.24, and the content of titanium is found to be 100 ppm.

[Preparation of a Developer and Evaluation of Image Quality]

An electrostatic image developer (2) is prepared in the same manner as in Example 1 except for using the toner particles (2) instead of the toner particles (1), and evaluated in the same manner as in Example 1. As a result, the charge quantity of the toner is found to be −41 μC./g and the charge retention rate after one week is found to be 92%. Therefore, it is understood that the developer has superior electrification properties. Also, the fixing temperature is found to be 105° C., which is as low as conventional developers cannot achieve. Regarding the image quality, scattering of the toner is not observed and uniform images with sufficient image density are obtained. Accordingly, the image characteristics are superior and sufficient for practical use.

Example 3

[Preparation of Toner Particles (3)]

Toner particles (3) are prepared in the same manner as in the preparation of the toner particles (1) in Example 1 except that 629.5 parts by weight of the non-crystalline polyester resin dispersion liquid (3) is used in place of 800 parts by weight of the non-crystalline polyester resin dispersion liquid (1) and that 170.5 parts by weight of the crystalline polyester resin dispersion liquid (7) is further used. The volume average particle diameter of the final toner particles is measured by a Coulter Counter (trade name: TA-IL model, manufactured by Coulter Company, aperture diameter: 50 μm), and found to be 6.2 μm. The volume average particle diameter distribution is found to be 1.24, and the content of titanium is found to be 150 ppm.

[Preparation of a Developer and Evaluation of Image Quality]

An electrostatic image developer (3) is prepared in the same manner as in Example 1 except for using the toner particles (3) in place of the toner particles (1), and evaluated in the same manner as in Example 1. As a result, the charge quantity of the toner is found to be −47 μC/g and the charge retention rate after one week is found to be 96%. There results indicate that the developer has good charge retention characteristics. Also, the fixing temperature is found to be 103° C., which is as low as conventional developers cannot achieve. Regarding the image quality, scattering of the toner is not observed and uniform images with sufficient image density are obtained. Accordingly, the image characteristics are found to be superior and sufficient for practical use.

Example 4

[Preparation of Toner Particles (4)]

Toner particles (4) are produced in the same manner as the preparation of the toner particles (1) in Example 1 except that 586.8 parts by weight of the non-crystalline polyester resin dispersion liquid (4) is used in place of 800 parts by weight of the non-crystalline polyester resin dispersion liquid (1) and that 213.2 parts by weight of the crystalline polyester resin dispersion liquid (7) is further used. The volume average particle diameter of the final toner particles is measured by a Coulter Counter (trade name: TA-11 model, manufactured by Coulter Company, aperture diameter: 50 μm), and found to be 6.4 μm. The volume average particle diameter distribution is found to be 1.24, and the content of titanium is found to be 200 ppm.

[Preparation of a Developer and Evaluation of Image Quality]

An electrostatic image developer (4) is prepared in the same manner as in Example 1 except for using the toner particles (4) in place of the toner particles (1), and evaluated in the same manner as in Example 1. As a result, the charge quantity of the toner is found to be −46 μC/g and the charge retention rate after one week is found to be 95%. These results indicate that the developer has good electrification properties. Also, the fixing temperature is found to be 98° C., which is as low as conventional developers cannot achieve. Regarding the image quality, scattering of the toner is not observed and uniform images with sufficient image density are obtained. Accordingly, the image characteristics are found to be superior and sufficient for practical use.

Example 5

[Preparation of a Toner Particle (5)]

Toner particles (5) are produced in the same manner as the preparation of the toner particles (1) in Example 1 except that 672.1 parts by weight of the non-crystalline polyester resin dispersion liquid (5) is used in place of 800 parts by weight of the non-crystalline polyester resin dispersion liquid (1) and that 127.9 parts by weight of the crystalline polyester resin dispersion liquid (7) is further used. The volume average particle diameter of the final toner particles is measured by a Coulter Counter (trade name: TA-IL model, manufactured by Coulter Company, aperture diameter: 50 μm), and found to be 5.5 μm. The volume average particle diameter distribution is found to be 1.25, and the content of titanium is found to be 50 ppm.

[Preparation of a Developer and Evaluation of Image Quality]

A developer is manufactured in the same manner as in Example 1 except for using the toner particles (5) in place of the toner particles (1), and evaluated in the same manner as in Example 1. As a result, the charge quantity of the toner is found to be −41° C./g and the charge retention rate after one week is found to be 93%. Therefore, the developer is found to have superior electrification properties. Also, the fixing temperature is found to be 100° C., which is as low as conventional developers cannot achieve. Regarding the image quality, scattering of the toner is not observed and uniform images with sufficient image density are obtained. Accordingly, the image characteristics are found to be superior and sufficient for practical use.

Comparative Example 1

[Preparation of a Toner Particle (6)]

Toner particles (6) are produced in the same manner as the preparation of the toner particles (1) in Example 1 except that 800 parts by weight of the non-crystalline polyester resin dispersion liquid (6) is used in place of the non-crystalline polyester resin dispersion liquid (1). The volume average particle diameter of the final toner particles is measured by a Coulter Counter (trade name: TA-11 model, manufactured by Coulter Company, aperture diameter: 50 μm), and found to be 5.9 μm. The volume average particle diameter distribution is found to be 1.24, and the content of titanium is found to be 100 ppm.

[Preparation of a Developer and Evaluation of Image Quality]

A developer is manufactured in the same manner as in Example 1 except for using the toner particles (6) in place of the toner particles (1). The obtained developer is evaluated in the same manner as in Example 1. As a result, the charge quantity of the toner is found to be −10 μC/g and the charge retention rate after one week is found to be 65%. Therefore, the charge quantity of the developer is found to vary widely, giving rise to a big practical problem. Also, the fixing temperature is found to be 145° C. Regarding image quality, significant scattering of the toner is observed. Also, the initial image density and uniformity thereof are unsatisfactory and practically problematic.

Comparative Example 2

[Preparation of a Toner Particle (7)]

Toner particles (7) are produced in the same manner as the preparation of the toner particles (1) in Example 1 except that 629.5 parts by weight of the non-crystalline polyester resin dispersion liquid (6) is used in place of the non-crystalline polyester resin dispersion liquid (1) and that 170.5 parts by weight of the crystalline polyester resin dispersion liquid (7) is further used. The volume average particle diameter of the final toner particles is measured by a Coulter Counter (trade name: TA-II model, manufactured by Coulter Company, aperture diameter: 50 μm), and found to be 6.1 μm. The volume average particle diameter distribution is found to be 1.23, and the content of titanium is found to be 100 ppm.

[Preparation of a Developer and Evaluation of Image Quality]

A developer is prepared in the same manner as in Example 1 except for using the toner particles (7) instead of the toner particles (1). The obtained developer is evaluated in the same manner as in Example 1. As a result, the charge quantity of the toner is found to be as low as −11 μC/g, and the charge retention rate after one week is 46%. Therefore, the charge quantity of the developer is found to vary widely, giving rise to a big practical problem. Also, the fixing temperature is found to be 120° C., which is lower than the fixing temperatures of conventional developers. However, regarding image quality, significant scattering of the toner is observed. Also, the initial image density and uniformity thereof are unsatisfactory and practically problematic.

TABLE 1

| | | Example 1 | Example 2 | Example 3 | Example 4 | Example 5 | Comparative Example 1 | Comparative Example 2 |
|---|---|---|---|---|---|---|---|---|
| Non-crystalline polyester resin | Type | Non-crystalline polyester resin (1) | Non-crystalline polyester resin (2) | Non-crystalline polyester resin (3) | Non-crystalline polyester resin (4) | Non-crystalline polyester resin (5) | Non-crystalline polyester resin (6) | Non-crystalline polyester resin (6) |
| | Copolymerization ratio of a propylene oxide adduct of bisphenol A (mol %)(1) | 66 | 100 | 100 | 100 | 100 | 100 | 100 |
| | Ratio of a monomer containing a sulfonic acid group (mol %)(2) | 0.5 | 5 | 10 | 15 | 5 | 0 | 0 |
| | Copolymerization ratio of dodecenylsuccinic acid (mol %)(3) | 0 | 0 | 2 | 0 | 10 | 0 | 0 |
| | Gardner color scale | 1 | 3 | 2 | 2 | 2 | 4 | 4 |
| | Secondary transition temperature (Tg, ° C.) | 60 | 65 | 63 | 59 | 55 | 67 | 67 |
| | Softening temperature (Tm, ° C.) | 110 | 118 | 115 | 105 | 95 | 125 | 125 |
| Crystalline polyester resin | Content ratio (wt %) | 0 | 15 | 20 | 25 | 15 | 0 | 20 |
| Titanium | Content (ppm) | 10 | 100 | 150 | 200 | 50 | 100 | 100 |
| Results of evaluation | Initial electrification property (μC/g) | −42 | −41 | −47 | −46 | −41 | −10 | −11 |
| | Charge retention ratio (%) | 94 | 92 | 96 | 95 | 93 | 65 | 46 |
| | Fixing temperature (° C.) | 118 | 105 | 103 | 98 | 100 | 145 | 120 |
| | Image quality | A | A | A | A | A | C | C |

(1)mol % based on the total amount of polyhydric alcohol.
(2)mol % based on the amount of the non-crystalline polyester resin.
(3)mol % based on the total acid components of the non-crystalline polyester resin.

As is clear from the above results, the toners of Examples 1 to 5 are superior in all of fixing characteristics, electrification properties and image characteristics of the toner, and realize the low-temperature fixing characteristics that have been considered to be difficult to achieve and satisfactory electrification properties important for the toner. Accordingly, Examples 1 to 5 provide an imaging method that achieves superior image characteristics.

We claim:

1. An electrostatic image developing toner comprising a non-crystalline polyester resin and a crystalline polyester resin, wherein the non-crystalline polyester resin is obtained by copolymerizing monomers in the presence of a titanium catalyst, without using a tin catalyst, the monomers comprising:

a polyhydric alcohol component comprising a propylene oxide adduct of bisphenol A;

terephthalic acid and fumaric acid as a polycarboxylic acid component; and a monomer containing a sulfonic acid group, comprising 5-sulfoisophthalate, a ratio of an amount of the monomer containing a sulfonic acid group to the total amount of the non-crystalline polyester resin is 0.1 mol % to 20 mol %, a content of titanium remaining present in the toner is 1 ppm to 1000 ppm by weight based on the amount of the resin, the non-crystalline polyester resin has a Gardner color scale of 3 or less, and the crystalline polyester resin is present in an amount of 3% by weight to 50% by weight based on the weight of the toner.

2. The electrostatic image developing toner according to claim 1, wherein the non-crystalline polyester resin has a second transition temperature (Tg) of 50° C. to 70° C., and a softening point (Tm) of 90° C. to 120° C.

3. The electrostatic image developing toner according to claim 1, wherein the non-crystalline polyester resin comprises dodecenylsuccinic acid as a polyvalent carboxylic acid copolymerization component in an amount of 1 mol % to 20 mol % based on the total amount of acid component in the non-crystalline polyester resin.

4. The electrostatic image developing toner according to claim 1, wherein the non-crystalline resin comprises a linear aliphatic diol whose main chain has 2 to 20 carbon atoms.

5. The electrostatic image developing toner according to claim 1, wherein the toner further comprises a releasing agent having a melting point of 50 to 100 ° C.

6. An electrostatic image developer comprising the electrostatic image developing toners of claim 1 and a carrier.

7. The electrostatic image developer according to claim 6, wherein the carrier is coated with a resin, and the resin comprises a conductive material.

8. The electrostatic image developer according to claim 6, wherein a volume average particle diameter of the carrier is 10 to 500 μm.

9. A method of producing an electrostatic image developing toner, the method comprising:

mixing a resin fine particle dispersion liquid containing one or more non-crystalline polyester resins and crystalline polyester resins with a colorant dispersion liquid containing a colorant dispersed therein;

allowing the resin fine particles and the colorant to aggregate in an aqueous medium to form aggregates having a toner particle diameter; and then heating the aggregate to fuse components in each aggregate, wherein at least one of the non-crystalline polyester resins is obtained by copolymerizing monomers in the presence of a titanium catalyst, without using a tin catalyst, the monomers comprising:

a polyhydric alcohol component comprising a propylene oxide adduct of bisphenol A:

terephthalic acid and fumaric acid as a polycarboxylic acid component: and a monomer containing a sulfonic acid group, comprising 5-sulfoisophthalate, a ratio of an amount of the monomer containing a sulfonic acid group to the total amount of non-crystalline polyester resin is 0.1 mol % to 20 mol %, an amount of titanium is contained in the toner, the non-crystalline polyester resin has a Gardner color scale of 3 or less, and the crystalline polyester resin is present in an amount from 3% by weight to 50% by weight based on the weight of the toner.

10. The method of producing an electrostatic image developing toner according to claim 9, comprising adhering at least one non-crystalline polyester resin to surfaces of the aggregates after formation of aggregates, and heating the aggregates to fuse components of each aggregate.

11. An image forming method comprising:

forming an electrostatic latent image on a surface of a latent image holding member;

developing the electrostatic latent image formed on the latent image holding member with a developer containing a toner to form a toner image;

transferring the toner image formed on the surface of the latent image holding member to a surface of an image receiving member; and thermally fixing the toner image transferred to the surface of the image receiving member, wherein the toner is the electrostatic image developing toner of claim 1.

* * * * *